US006951082B2

(12) United States Patent
Nelson et al.

(10) Patent No.: US 6,951,082 B2
(45) Date of Patent: Oct. 4, 2005

(54) DRILLING RIG WITH TORQUE CARRIER

(75) Inventors: Allan R. Nelson, Edmonton (CA); Mark E. Mattock, Airdrie (CA)

(73) Assignee: Allan R. Nelson Engineering (1977), Edmonton (CA)

( * ) Notice: Subject to any disclaimer, the term of this patent is extended or adjusted under 35 U.S.C. 154(b) by 111 days.

(21) Appl. No.: 10/335,879

(22) Filed: Jan. 3, 2003

(65) Prior Publication Data

US 2004/0129417 A1 Jul. 8, 2004

(51) Int. Cl.[7] ..... E04H 12/34

(52) U.S. Cl. ..... 52/112; 52/117; 52/118; 52/119; 52/120; 175/321; 175/322

(58) Field of Search ..... 52/112, 121, 118, 52/117, 119, 120, 651.05, 111; 175/321, 322, 220; 182/3, 4, 5, 6, 7, 8, 9, 207, 141, 142, 143, 144, 147, 128

(56) References Cited

U.S. PATENT DOCUMENTS

| | | | | | |
|---|---|---|---|---|---|
| 4,590,720 | A | * | 5/1986 | Reed | 52/121 |
| 4,837,992 | A | * | 6/1989 | Hashimoto | 52/118 |
| 4,865,135 | A | | 9/1989 | Moses | |
| 5,161,639 | A | * | 11/1992 | Ice | 182/8 |
| 5,251,709 | A | * | 10/1993 | Richardson | 175/220 |
| 5,381,867 | A | * | 1/1995 | Berry | 175/85 |
| 5,433,279 | A | | 7/1995 | Tessari et al. | |
| 5,501,286 | A | * | 3/1996 | Berry | 175/52 |
| 5,755,296 | A | * | 5/1998 | Richardson et al. | 175/162 |
| 5,921,329 | A | * | 7/1999 | Armstrong | 175/57 |
| 6,024,181 | A | * | 2/2000 | Richardson et al. | 175/162 |
| 6,618,999 | B1 | * | 9/2003 | Reynolds | 52/120 |

FOREIGN PATENT DOCUMENTS

| | | |
|---|---|---|
| CA | 2118608 | 3/1996 |

OTHER PUBLICATIONS

Product information brochure entitled "Integraline 150iH Top Drive for Double Rigs." Estec Oilfield, May 30, 2002. 4 pages.

Product information brochure entitled "Integraline 150iH Top Drive: Designed specifically for double and super–s-ingle rigs." Estec Oilfield, Nov. 28, 2001. 2 pages.

* cited by examiner

*Primary Examiner*—Carl D. Friedman
*Assistant Examiner*—Nahid Amiri
(74) *Attorney, Agent, or Firm*—Anthony R. Lambert

(57) ABSTRACT

A telescoping rig with an upper mast telescopingly received within a lower mast. A torque carrier is formed of an upper part suspended within the upper mast and a lower part attached to the lower mast. The lower part may be secured to the upper part when the rig is in operational position, and is movable to allow the upper mast to move into a telescoped position within the lower mast. The rig is readied for transport by disconnecting upper and lower parts of a torque carrier, moving the lower torque carrier laterally within the lower mast to allow the upper mast to telescope within the lower mast; and telescoping the upper mast within the lower mast.

14 Claims, 4 Drawing Sheets

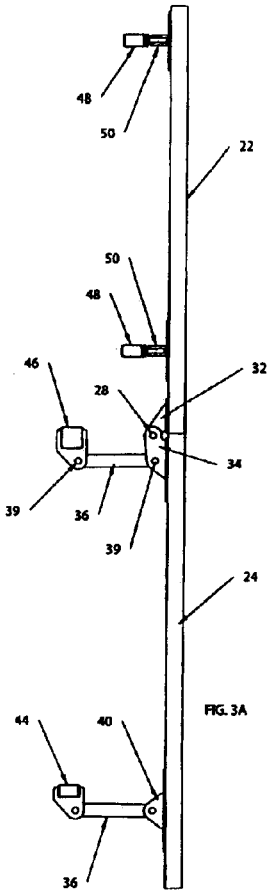
FIG. 3A
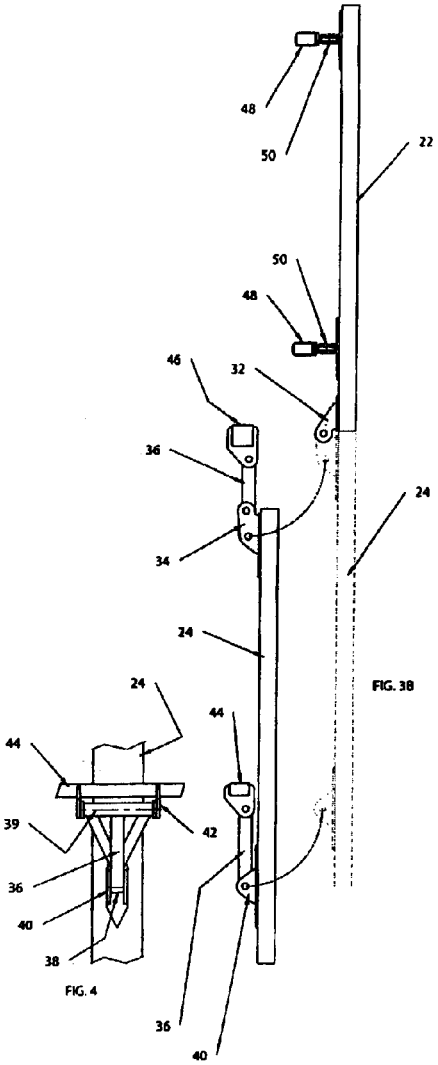
FIG. 3B
FIG. 4
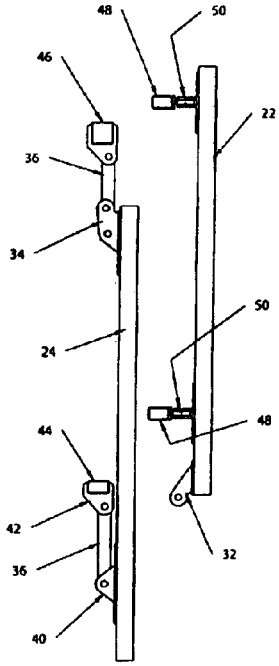
FIG. 3C

DRILLING RIG WITH TORQUE CARRIER

BACKGROUND OF THE INVENTION

To rotate tubing within a well, drilling rigs often have top drives that are suspended from drilling masts. When the top drives rotate the tubing, torque generated by the top drives must be transmitted to the rear of the mast and into the supporting structure. For this purpose, it is conventional to provide a torque carrier running along the height of the mast along which the top drive slides. The torque carrier is fastened to the mast to transmit torque into the mast. Larger rigs also are equipped with upper and lower masts that can be telescoped together for transport. When these larger telescoping rigs are dismantled, the torque carrier must be removed to allow the upper mast to telescope into the lower mast. This process is time consuming. This invention is directed to a telescoping rig with torque carrier that facilitates readying a rig for transport.

SUMMARY OF THE INVENTION

Therefore, according to an aspect of the invention, there is provided a telescoping rig with an upper mast telescopingly received within a lower mast. A torque carrier is formed of an upper part suspended within the upper mast and a lower part attached to the lower mast. The lower part may be secured to the upper part when the rig is in operational position, and is movable to allow the upper mast to move into a telescoped position within the lower mast.

According to a method of the invention, a rig having an upper mast and a lower mast is readied for transport by disconnecting upper and lower parts of a torque carrier, moving the lower torque carrier laterally within the lower mast to allow the upper mast to telescope within the lower mast; and telescoping the upper mast within the lower mast. A torque drive may then remain in the rig during transportation, and remain attached to the torque carrier, preferably the upper torque carrier, thus facilitating transportation of the rig.

According to a further aspect of the invention, the lower torque carrier is attached to the lower mast by pivots, for example swinging arms that swing in a vertical plane downward, to allow the lower torque carrier to swing out of the way of the upper mast when the upper mast is moved into the telescoped position.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which:

FIGS. 3A, 3B and 3C respectively show side views of a torque carrier, for use with a rig according to the invention, in which FIG. 3A shows the torque carrier in operational position, FIG. 3B shows the torque carrier disconnected ready for telescoping of the rig and FIG. 3C shows the torque carrier in telescoped position ready for transport;

FIG. 4 shows an end view of a swinging arm for the torque carrier of FIG. 3B.

DETAILED DESCRIPTION OF PREFERRED EMBODIMENTS

In this patent document, "comprising" means "including". In addition, a reference to an element by the indefinite article "a" does not exclude the possibility that more than one of the element is present. The telescoping rig of the present invention is typically a drilling rig.

Figures 1A, 1B, 1C:
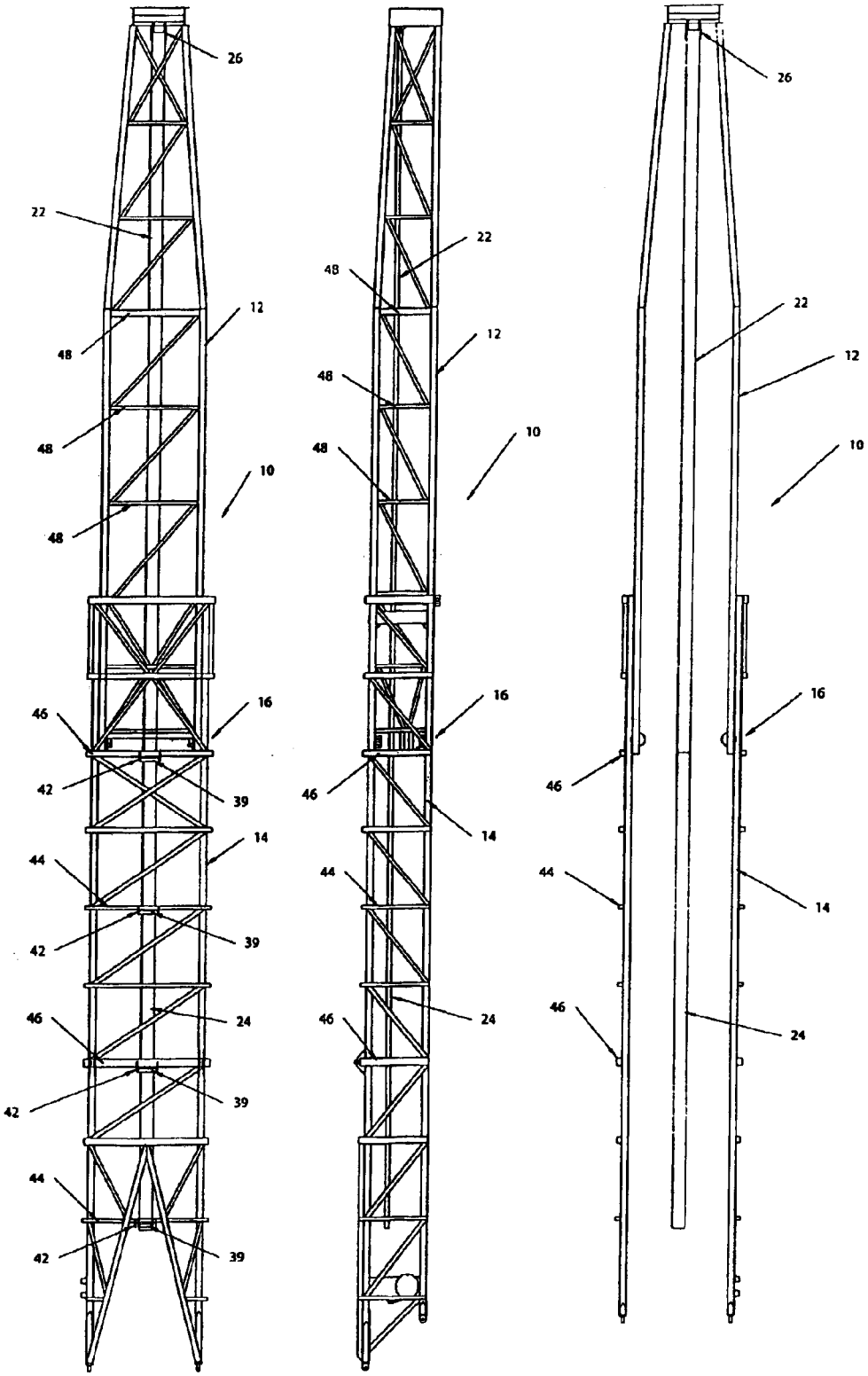
FIGS. 1A, 1B and 1C respectively show a rear view, side view and front view of a rig according to the invention, with the rig in operational position.

Referring to FIGS. 1A, 1B and 1C there is shown a telescoping rig 10 formed of an upper mast 12, and lower mast 14 received within and extending from the upper mast 12 in an operational position for drilling. The construction of the masts 12 and 14 is conventional other than as described here and need not be described in further detail. As is typical with telescoping masts, the upper mast 12 is pinned to the lower mast 14 at 16 to hold it in operational position. A torque carrier mounted in the rig 10 is formed of an upper torque carrier 22 and a lower torque carrier 24. The upper torque carrier 22 is suspended from the top of the upper mast 12 by link 26 in conventional manner. As shown in FIG. 3A, the upper torque carrier 22 is fastened to the lower torque carrier 24 using a pin 28 that passes through openings in flange 32 on the upper torque carrier 22 and flange 34 on lower torque carrier 24.

As shown in FIGS. 3A, 3B and 3C, the lower torque carrier 24 is pivotally attached to the lower mast 14 by swinging arms 36 that are pivotally attached to the lower torque carrier 24 by pins 38 and to the lower mast 14 by pins 39. The pins 38 are received within openings at the torque carrier ends of the swinging arms 36 and within openings in flanges 34, 40 attached to the lower torque carrier 24. Only one flange 40 is shown in FIGS. 3A, 3B, 3C and 4. The pins 39 are received within openings at the mast ends of the swinging arms 36 and within openings in flanges 42 attached to cross-members 44, 46 on the lower mast 14. Any suitable manner of connection of the flanges 42 to the cross-members 44, 46 may be used, such as bolting, welding or clamping. The swinging arms 36 swing in a vertical arc downward as shown in FIG. 3B to move the lower torque carrier 24 out of the way of the upper mast 12 when it telescopes within the lower mast 14 as shown in FIGS. 2A–2C and FIG. 3C.

The upper torque carrier 22 is connected to cross-members 48 on the upper mast 12 by swinging or rotating arms 50. As many swinging arms 50 are used as conventionally required, and the swinging arms 50 may be designed conventionally to allow the torque carrier to rotate about a central axis passing vertically through the rear of the upper mast 12 at the points of connection of the swinging arms 50 to the upper mast 12.

Figure 2A:
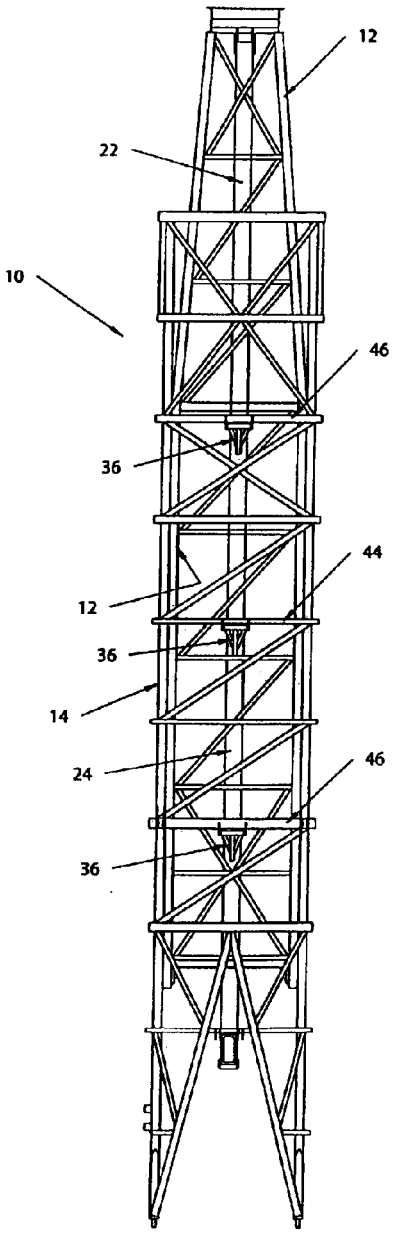
FIGS. 2A, 2B and 2C respectively show a rear view, side view and front view of rig according to the invention in telescoped position ready for transport.
Figure 2B:
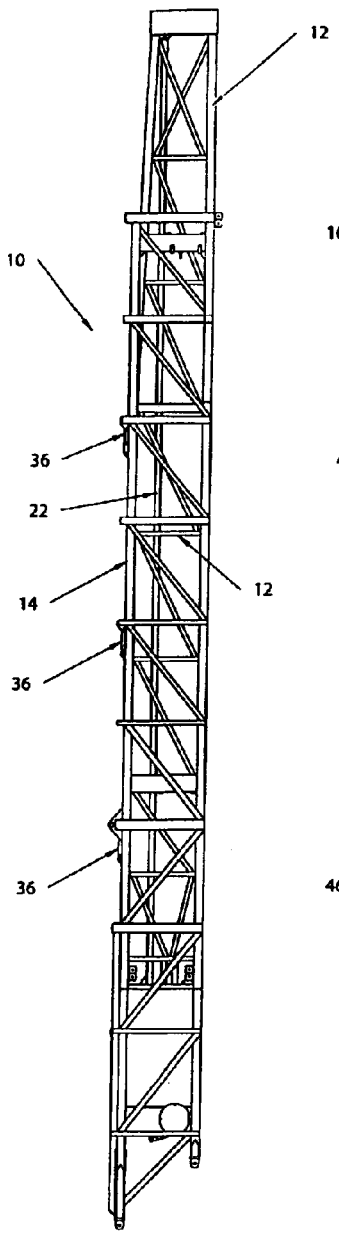
Figure 2C:
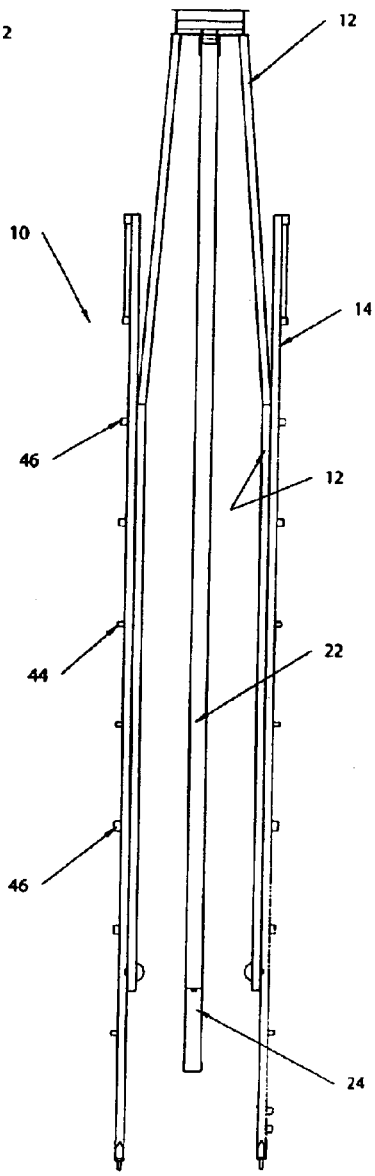

The rig 10 is readied for transport by disconnecting the lower torque carrier 24 from the upper torque carrier 22 as shown in FIG. 3B, and moving the lower torque carrier 14 laterally within the lower mast 14 to allow the upper mast 12 to telescope within the lower mast 14 to reach the transport position illustrated in FIGS. 2A, 2B and 2C. The upper mast 12 is then telescoped within the lower mast 14 by removing the pins at 16 and sliding the upper mast 12 down within the lower mast 14. As shown in FIG. 3B, the lower torque carrier 24 is moved laterally on the swinging arms 36, which swing downward in a vertical plane to allow the upper mast 12 to telescope within the lower mast 14.

Movement of the upper mast 12 within the lower mast 14 is controlled in conventional fashion with for example hydraulic cylinders, cables and winches (not shown). It is also convenient to restrain the upper torque carrier 22 and lower torque carrier 24 within the rig during transport, by any of various suitable means, such as cables.

Figure 5A:
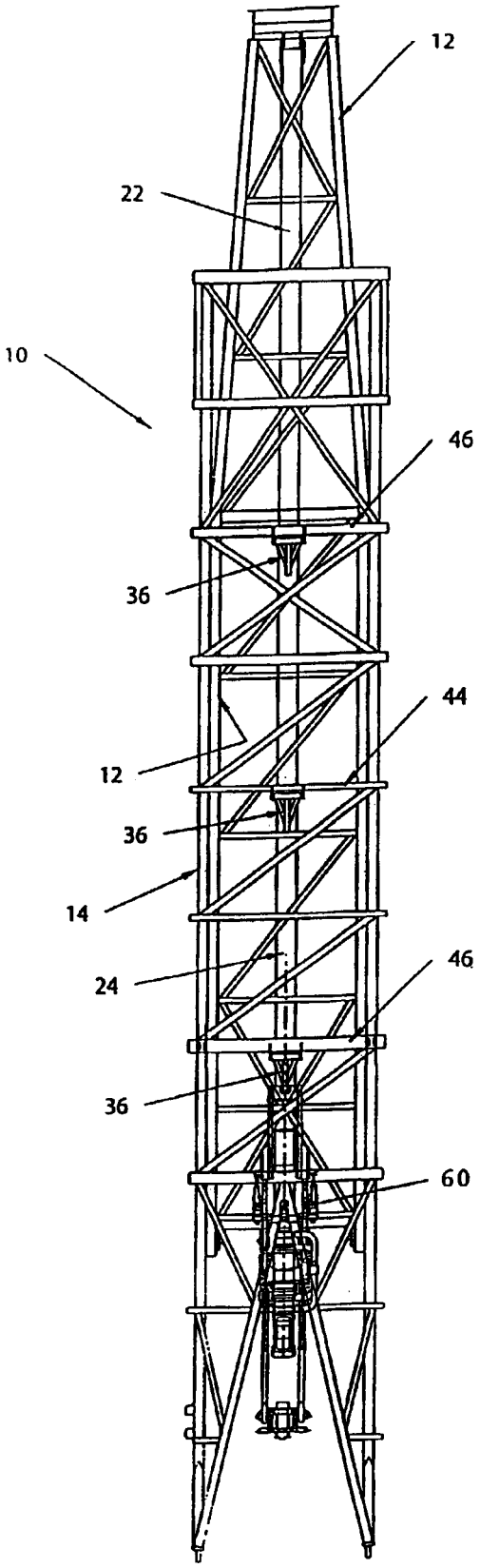
FIGS. 5A and 5B are respectively a front view and side view of a telescoped rig with top drive inside the telescoped rig for transportation.
Figure 5B:
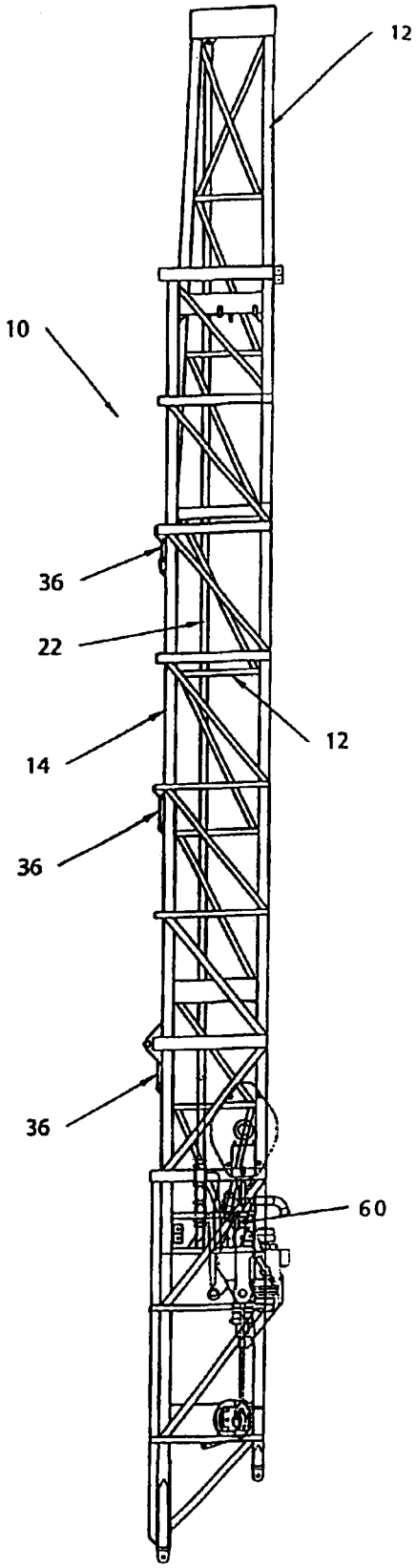

Referring to FIGS. 5A and 5B, the displacement of the torque carrier 22 to one side of the mast 12 allows a top drive 60 to remain in the mast 12 during transportation. The top drive 60 need not be detached from the upper torque carrier 22, thus facilitating set up and tear down of the rig. The top drive 60 could be left attached to the lower torque carrier but this makes it harder to move the lower torque carrier out of the way.

Immaterial modifications may be made to the invention described here without departing from the essence of the invention. While one way of moving the lower torque carrier out of the way has been described, other ways are possible, such as swinging the lower torque carrier about a vertical axis, or retraction on a telescoping arm. In addition, the torque carrier may be made in more than two pieces. Various ways of connecting the upper and lower torque carriers together in a detachable manner may be used such as clamps, releasable bolts, etc. Various materials may be used for the components such as are conventional in drilling rig design. The torque carrier may be of any shape, such as tubular, triangular, tubular with guides or I-shaped. The word "carrier" is used here to describe any device that can convey torque of a top drive to a mast of a drilling rig and along which the top drive can move.

What is claimed is:

1. A telescoping rig, comprising:

a lower mast;

an upper mast received within the lower mast and movable between an operational position extending above the lower mast and a telescoped position inside the lower mast;

an upper torque carrier suspended within the upper mast;

a lower torque carrier attached to the lower mast;

the lower torque carrier being attachable to the upper torque carrier when the upper mast is in the operational position; and the lower torque carrier being movable to allow the upper mast to move into the telescoped position.

2. The telescoping rig of claim 1 in which the lower torque carrier is attached to the lower mast by pivots to allow the lower torque carrier to swing out of the way of the upper mast when the upper mast is moved into the telescoped position.

3. The telescoping rig of claim 2 in which the lower torque carrier is attached to the lower mast by plural arms, each arm being pivotally attached to the lower mast and to the lower torque carrier.

4. The telescoping rig of claim 3 in which the arms swing in a vertical plane.

5. The telescoping rig of claim 4 in which the arms swing downward when the lower torque tub swings out of the way of the upper mast.

6. A method of readying a rig for transport, in which the rig incorporates a lower mast, an upper mast telescopically received within the lower mast, an upper torque carrier and a lower torque carrier, the method comprising the steps of:

disconnecting the lower torque carrier from the upper torque carrier;

moving the lower torque carrier laterally within the lower mast to allow the upper mast to telescope within the lower mast; and telescoping the upper mast within the lower mast.

7. The method of claim 6 in which the lower torque carrier is moved laterally on swinging arms pivotally attached to the lower mast.

8. The method of claim 7 in which the swinging arms swing downward to allow the upper mast to telescope within the lower mast.

9. The method of claim 6 in which the rig includes a top drive and further comprising the step of keeping the top drive within the telescoped rig for transportation.

10. The method of claim 9 in which the top drive remains secured to one of the upper torque carrier and the lower torque carrier during transportation.

11. The method of claim 10 in which the torque carrier to which the top drive is attached during transportation is the upper torque carrier.

12. The method of claim 6 in which the rig is a drilling rig.

13. The telescoping rig of claim 1 in which the telescoping rig is a drilling rig.

14. The telescoping of claim 1 in which the lower torque carrier moves within the lower mast when the upper mast is telescoped within the lower mast.

* * * * *